US008997410B1

(12) United States Patent
Starks, Jr. et al.

(10) Patent No.: US 8,997,410 B1
(45) Date of Patent: Apr. 7, 2015

(54) SEAM STABILIZER FOR STANDING SEAM PANELS

(71) Applicant: Building Research Systems, Inc., Edmond, OK (US)

(72) Inventors: Richard G. Starks, Jr., Oklahoma City, OK (US); Ralph L. Herren, Newcastle, OK (US)

(73) Assignee: Building Research Systems, Inc., Edmond, OK (US)

( * ) Notice: Subject to any disclaimer, the term of this patent is extended or adjusted under 35 U.S.C. 154(b) by 0 days.

(21) Appl. No.: 13/624,756

(22) Filed: Sep. 21, 2012

Related U.S. Application Data

(60) Provisional application No. 61/537,853, filed on Sep. 22, 2011.

(51) Int. Cl.
*E04G 21/04* (2006.01)
*E04G 21/16* (2006.01)

(52) U.S. Cl.
CPC ..... *E04G 21/167* (2013.01)

(58) Field of Classification Search
USPC ..... 52/127.2, 749.12, DIG. 1, DIG. 15; 29/267, 283.5
See application file for complete search history.

(56) References Cited

U.S. PATENT DOCUMENTS

| | | | | | |
|---|---|---|---|---|---|
| 2,360,879 | A | * | 10/1944 | Kroier | 52/520 |
| 3,624,876 | A | * | 12/1971 | Irvin | 29/267 |
| 3,641,729 | A | * | 2/1972 | Irvin | 52/528 |
| D278,511 | S | * | 4/1985 | Smith | D8/52 |
| 4,525,976 | A | * | 7/1985 | Simpson | 52/748.1 |
| 4,531,397 | A | * | 7/1985 | Pratt | 72/451 |

* cited by examiner

*Primary Examiner* — Basil Katcheves
(74) *Attorney, Agent, or Firm* — Hall Estill Attorneys at Law

(57) ABSTRACT

A seam stabilizer for maintaining standing seam roof panels on module during installation, the seam stabilizer having profile members that provide pressing force on the standing seam for maintaining and aligning the horizontal and vertical shape of the standing seam formed at interconnected upstanding corrugations along the length of adjacent panels; a pressing mechanism moves the profile members into pressing engagement with the standing seam during installation. Further, a module set gauge extends between the profile members to fit over the opposing upstanding edge of the adjacent panel and secure same on module as the edge is secured to the underlying support members.

6 Claims, 10 Drawing Sheets

SEAM STABILIZER FOR STANDING SEAM PANELS

RELATED APPLICATION

The current application claims priority to the U.S. Provisional Application Ser. No. 61/537,853 filed Sep. 22, 2012.

FIELD OF INVENTION

The present invention relates generally to modularly constructed roof systems, and more particularly but not by limitation, to apparatuses and methods of improving standing seam roofs.

DISCUSSION

Standing seam roof panels can generally be classified as having trapezoidal or pan panel profiles, both of which profiles having longitudinal edges that are interconnected by overlapping seam or edge corrugations. Trapezoidal profile roof panels present the difficulty of maintaining the roof panels on specified module dimensions during installation.

The sequence of installing standing seam roof panels begins by securing a starting roof panel to a supporting structure member, usually purlins, by means of attaching clips that engage the edge male corrugation of the positioned roof panel and attached to the supporting structure member such as by self-tapping screws. The next panel is placed adjacent to the first panel, with its edge female corrugation placed over the previously placed panel's edge male corrugation. Thus, each of the positioned panels provides one half of the standing seam formed by the overlapping edge corrugations; the overlapping male and female edge corrugations are then seamed together. This sequence is followed as additional roof panels are edge overlapped, secured by clips to the supporting members and edge seamed together.

The established practice in the metal building industry has been to provide hold-down clips that connect to the roof panels at the standing seams and are affixed to the underlying purlins, joists or deck. The standing seams of the panels are usually sealed to eliminate or minimize the invasion of moisture from the environment through the standing seams into the protected building interior.

During the installation of trapezoidal panels, and to some lesser extent with pan panels, it is necessary for installers to maintain the panels on module; that is, on module as used herein refers to panels installed to have overlapping edge corrugations disposed directly over the supporting structurals at predetermined spatial dimensions. Panel widths can vary from the designed and original formed width to a wider width due to the fact that the panel material is thin, usually 24 or 22 gauge, and during shipping and handling the formed shape of the corrugations is frequently slightly deformed.

Furthermore, the panel widths are frequently slightly deformed during positioning of the panels as installers walk on the panels, causing deflections in the panel flat, which in turn increases the width of the panels. If panels are not maintained on module during installation, other preformed roofing components, such as closures and flashings, will not mate up with the panel shapes, creating sealing problems around the perimeter and at framed openings. Also, panel seams out of module cause misalignment of the seam elements, resulting in an improperly mechanically formed seam that can cause decreased weather resistance and possibly reduced structural strength.

Several methods are conventionally used to try to maintain panel module. For instance, panel module boards having spaced apart notches are set to fit over the top seam (not the edge corrugations) to attempt to hold the panels on module, but such have proven to be grossly ineffective. Another method used is having purlins (or joists) pre-drilled with holes to accept clip fasteners at the panel module, but this has not found any significant acceptance due to the time and cost inefficiencies created thereby. Others have attempted to use a tape measure to track the panel module: when the panels get off module, a clamp is used to squeeze, and thereby distort out of shape, the panel corrugation of the previously installed panels to try to pull the panels back onto module, a technique that has largely failed. All of these methods, due to the skill required and the time consumed, have met with but limited, if any, success.

It is clear that there is a need for a means of more accurately locking panel corrugations together to avoid panel module creep during construction. It is to this need that the present invention is directed.

SUMMARY OF INVENTION

The present invention provides an apparatus and method to facilitate the positioning of standing seam roof panels, with the apparatus positioned over a standing seam corrugation to secure the design shape of the corrugation in place while retaining the leading corrugation on module so that clips will be located on module as they are installed.

That is, the present invention provides a seam stabilizer that maintains the standing seam roof panels on module during installation, one or more of the seam stabilizers placed over the upstanding seam profile in their open mode, and when moved to their closed mode, opposing profile members provide a pressing force on the standing seam edges to maintain and align the horizontal and vertical shape of the standing seam along the length of adjacent panels. Further, a module set gauge can be extended between the profile members across an adjacent panel to connect over the opposing upstanding edge, the length of the module set gauge determined to secure the opposing upstanding edge on module as that edge is secured to the underlying support members.

The features, advantages and objects of the present invention will be apparent from a reading of the following detailed description in view of the associated drawings and appended claim.

DESCRIPTION OF THE INVENTION

Numerous possible variations and modifications will readily occur to a skilled artisan upon reviewing the following description. Thus, it will be understood that the various exemplary embodiments described herein are illustrative of, and are not limiting to, the scope of the invention.

Figure 1:
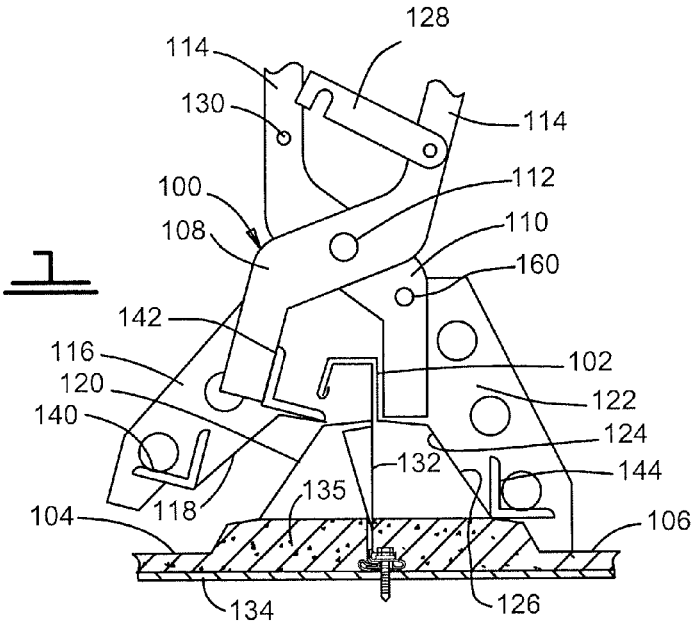
FIG. 1 is a partially cutaway, elevational view of a seam stabilizer constructed in accordance with the present invention and in juxtaposition to a standing seam.

Referring to the drawings in general, and more particularly to FIG. 1, shown therein is a seam stabilizer 100 constructed in accordance with the present invention. The seam stabilizer 100 is depicted as positioned in an open mode and spatially disposed over a standing seam 102 formed by the edge overlapping of roof panels 104 and 106.

The seam stabilizer 100 has a first pivoting member 108 and a second pivoting member 110 that are interconnected by a pivot pin 112. Each of the pivoting members 108 and 110 has a handle end 114 that is shown truncated in the interest of reducing the drawing space. Supported by the lower end of the first pivoting member 108 is a first profile member 116 that has an inner profile surface 118 that is shaped to match with, or mate against, a portion of the profile shape of an upstanding edge or corrugation 120 of the roof panel 104; the skilled artisan will understand that the upstanding corrugation 120 provides the male insertion portion that joins with the female portion provided by the adjacent roof panel 106 to form the standing seam 102. Supported by the lower end of the second pivoting member 110 is a second profile member 122 that has an inner profile surface 124 that is shaped to match with, or mate against, a portion of the profile shape of upstanding corrugation 126 of the roof member 106.

Figure 2:
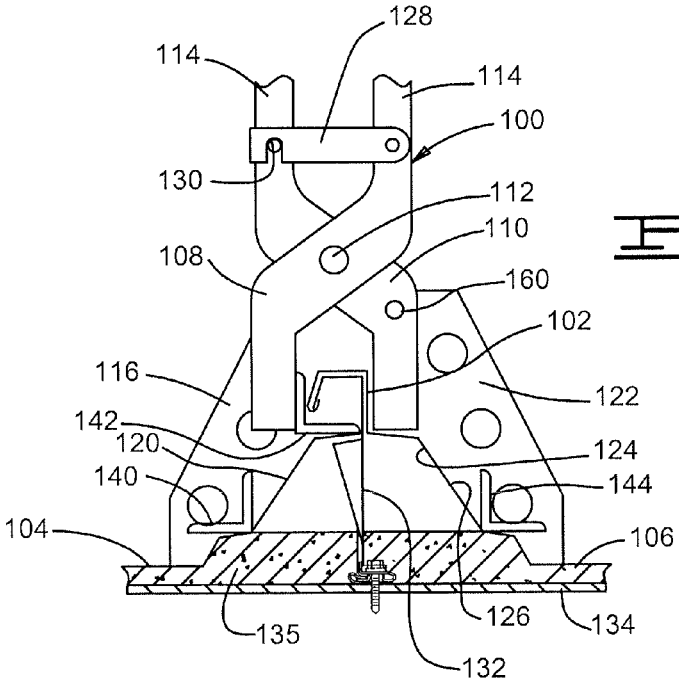
FIG. 2 is a partially cutaway, elevational view of the seam stabilizer of FIG. 1 as closed on the standing seam.

FIG. 2 shows the seam stabilizer 100 in the closed mode, in which manual squeezing by an operator of the handle ends 114 has rotated the first profile member 116 to position the inner profile surface 118 against the upstanding corrugation 120 of the roof panel 104. The seam stabilizer 100 is selectively dimensioned so that, in the closed mode depicted in FIG. 2, the upstanding trapezoidal crown formed by the upstanding corrugations 120, 126 is tightly squeezed, and a notched pivotal locking tab 128, supported by the first pivoting member 108, is pivotable to engage a lock pin 130 extending from the second pivoting member 110 in the manner shown in FIG. 2 to lock the seam stabilizer 100 in the closed mode, securely gripping the upstanding corrugations 120, 126 of the roof panels 104, 106. When the seam stabilizer 100 is placed over the panel edge profile and moved to the closed position and locked therein, the seam stabilizer serves to positively align the horizontal and vertical shape of the profile, thus maintaining the seam and shape integrity during the roof installation.

FIGS. 1 and 2 depict the profile member 122 being first positioned over the standing seam 102 and the profile member 116 being rotated toward the profile member 122 to assume the closed mode; it will be recognized that the profile member 116 can be positioned against the upstanding corrugation 120 and the profile member 122 rotated toward the profile member 116 to the closed mode. For reasons to be discussed below, there are certain standing seam shapes that will require this latter mentioned placement and rotation.

Figure 3:
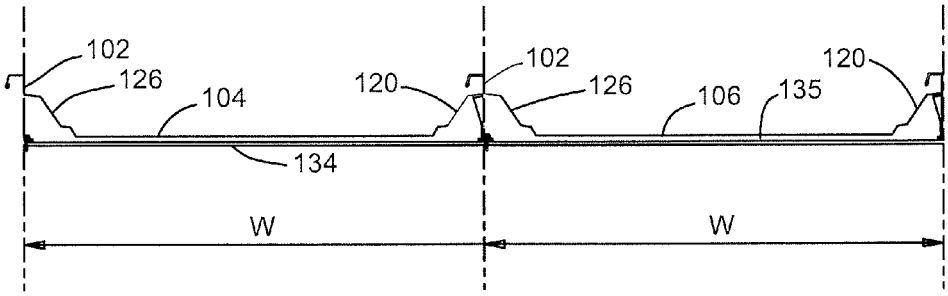
FIG. 3 is an end elevational view of roof panels of the type that are edge joined together to create a standing seam, the roof panels depicted on module.
Figure 4:
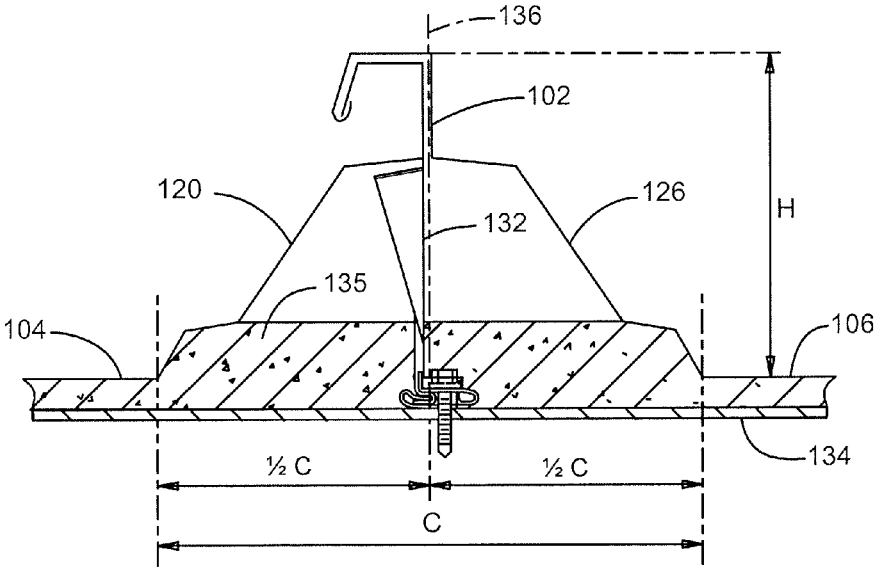
FIG. 4 is a partially detailed elevational view of edge joined panels forming the standing seam of FIG. 1.

Having described the seam stabilizer 100, the purpose of same will be made clear by reference to the remaining drawings. FIG. 3 illustrates the seam joined roof panels 104, 106 that are designed to have a modular distance of W when properly installed to form a roof that is supported by, and attached by clips 132 to, underlying structural members 134, a layer of insulation 135 usually disposed therebetween, as shown. As illustrated in FIG. 4, when adjacently installed roof panels are properly installed without distortion, the upstanding crown formed by the edges 120, 126 of the panels 104, 106 will be symmetrical about a centrally extending axis 136, and the dimension C between the crease lines of the roof panels 104, 106 at the upstanding corrugations 120, 126 of the trapezoidal crown will be symmetrically divided into equal values of ½ C, as depicted. Further, the standing seam 102 will extend above the medial portion of the panels 104, 106 by height H.

Figure 5:
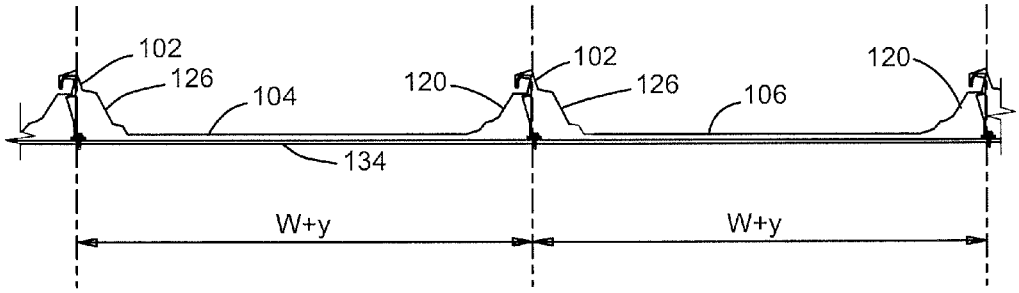
FIG. 5 is an end elevational view similar to that of FIG. 3 except depicting the roof panels as having expanded to an off module condition.
Figure 6:
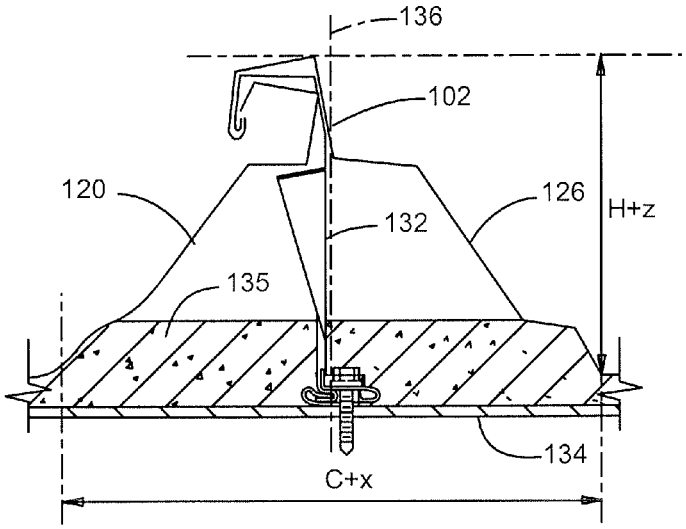
FIG. 6 is a partially detailed elevational view similar to that of FIG. 4 except illustrating the standing seam deformation due to the panel off module condition.

The views of FIGS. 5 and 6 show the same components as those of FIGS. 3 and 4, respectively, with the exception that the components in FIGS. 5 and 6 are depicted as distorted, as is typical in practice, having endured such distorting factors as packaging for shipping and bearing the installing distortions caused by workers standing on the panels during installation. It will be noted that the distortions have caused modular creep so that the modular distance is W+y (as compared to the modular distance W in FIG. 3), with y being the distance that the panels 104, 106 are spread off module when installed to form a roof. This distortion is also shown in FIG. 6 in which the standing seam 102 has been distorted as the crown distance C has grown to C+x, and the height of the standing seam 102 has lifted to H+z.

The purpose of the seam stabilizer 100 is to maintain the design shape of the standing seam 102 and the upstanding corrugations 120, 126 and to thus avoid or minimize the module creep illustrated in FIGS. 5 and 6; this will be described with reference to FIGS. 7 and 8 that illustrate the positioning of the first and second profile members 116, 122 of the seam stabilizer 100 in the open mode in FIG. 7 and in the closed mode in FIG. 8. For clarity, the first and second pivoting members 108, 110 are omitted in FIGS. 7 and 8; this omission also makes clear that numerous means, other than the manual opening and closing of handles 114, can be employed to position the seam stabilizer 100 in the open or closed mode on the standing seam 102.

With further attention to the structure of the seam stabilizer 100 (noting that the panel 104 is depicted as distorted to 104A), a crimping jaw 140 and a crimping jaw 142 are supported by the first profile member 116, and a crimping jaw 144 and a crimping jaw 146 are supported by the second profile member 122. The crimping jaws 140 through 144 are longitudinal channel members extending into the plane of the drawing sheets and each having a generally L-shaped cross-section.

The crimping jaw 140 has an engaging edge 140A that is disposed, along with the inner profile surface 118, to engage the upstanding corrugation 120 of the panel 104 when the seam stabilizer 100 is moved to its closed mode. The crimping jaw 142 has an engaging nesting finger 142A that extends to fit into the cavity of the standing seam 102 to engage the standing seam 102 when the seam stabilizer 100 is moved to its closed mode over the standing seam 102 as depicted in FIG. 8. The nesting finger 142A serves to align the edge corrugations horizontally and vertically to assume their design configurations. FIG. 8A shows an alternative crimping jaw 143 that has an upwardly directed nesting finger 143A. The shape and configuration of the standing seam 102 will dictate the shape of the nesting finger, and the nesting fingers 142A, 143A shown are by way of example only.

Figure 8:
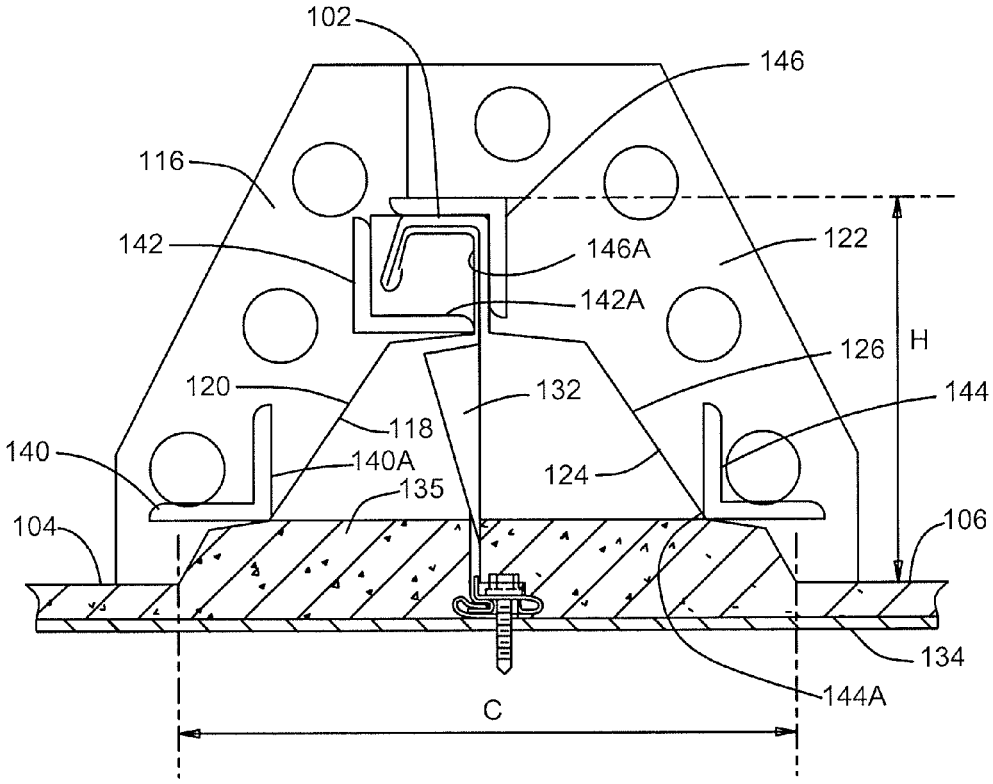
FIG. 8 is a partially detailed elevational view showing the clamping jaws of the seam stabilizer of FIG. 7 positioned in the closed mode on the standing seam.
Figure 8A:
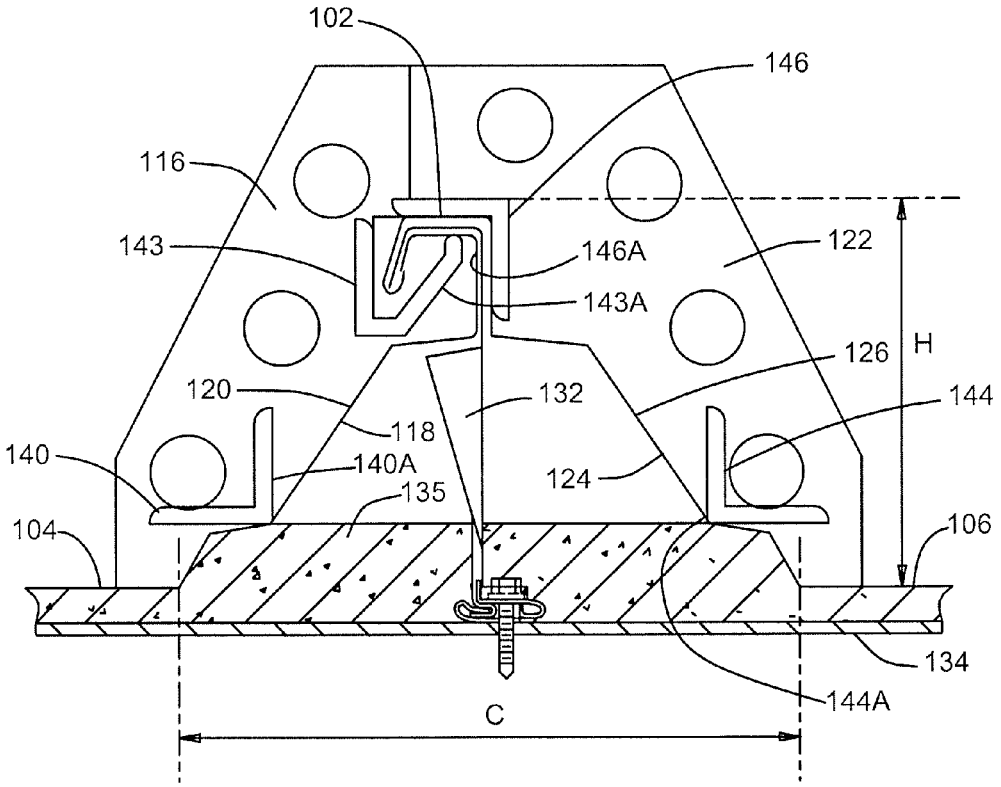
FIG. 8A show another embodiment of a seam stabilizer according to the present invention and is identical to that shown in FIG. 8 with the exception described herein.

In like manner, the crimping jaw 144 has an engaging edge 144A that is disposed, along with the inner profile surface 124, to engage the upstanding corrugation 126 of the panel 106 when the seam stabilizer 100 is moved to its closed mode in the position depicted in FIG. 8. The crimping jaw 146 has an engaging surface 146A that engages over the top portion of the panel 106 that forms, in cooperation with the top portion of panel 104, the standing seam 102.

Figure 7:
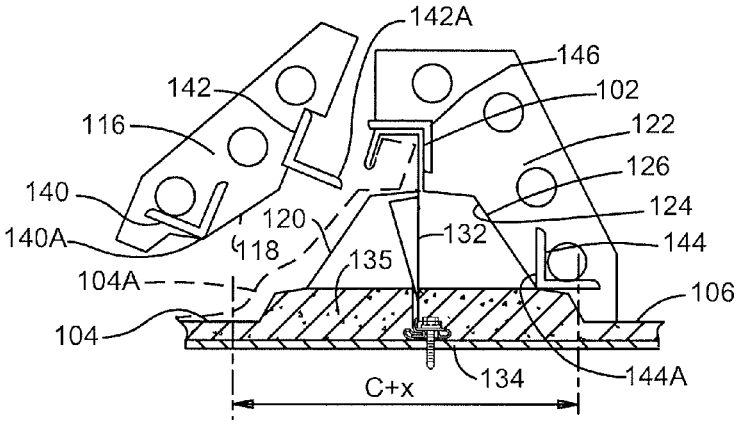
FIG. 7 is a partially detailed elevational view showing the clamping jaws of the seam stabilizer of FIG. 1 positioned to in the open mode set to be closed on the standing seam.

In operation, the application of the seam stabilizer 100, while in the open mode, is placed over the standing seam 102 and the upstanding corrugations 120, 126, and the seam crimping stabilizer device is moved to its closed mode to squeeze the standing seam components from the distorted profile of FIG. 7 to the on module profile of FIG. 8 (or FIG. 8A). In practice, a person skilled in the art will recognize that multiple seam stabilizers 100 will be employed along a standing seam to maintain its integrity. The manner of using the seam stabilizer 100 will first be described with reference to FIGS. 9 through 9C in which several seam stabilizers 100A through 100F are employed and sequentially moved on the standing seams 102 as the panels are installed.

A standing seam roof is preferably installed by placing a row of starting panels along one edge of the roof and sequentially positioning additional panels in an orderly manner adjacent to the first row; this is repeated with additional panels as the roof grows. To clarify this, with reference to FIG. 9, roof panels 104A, overlapped and joined at endlaps 105, are positioned over the underlying structural members (purlins) and secured there to via installation of clips 132 that hook over the male portion of the panels 104A.

Next, panels 106A, overlapped and joined at endlaps 107, are positioned so that their edge female corrugations overlap the edge male corrugations of the panels 104A in known fashion to form the standing seams 102 extending the length of the run. At this point, several spaced apart seam stabilizers 100A, 100B and 100C are mounted over the standing seams 102 of this run and once in place, the opposing male forming edges of the panels 106A can be secured to underlying structurals via clips 132. Placement of the seam stabilizers 100A-C squeeze via a forcing grip, assuring seam unity and avoiding seam distortion.

Once the panels 106A are secured in place, another row of end overlapped panels 104B are joined to the edge portions of the panels 106A to form the standing seam 102 in known fashion, and seam stabilizers 100D, 100E and 100F are clamped over the standing seam 102 as depicted. Once these are in place, stabilizing the standing seam 102 to avoid distortion, the far edge portions of the panels 104B can be secured to the underlying structurals by clips 132.

Once the clips 132 have secured the edge male corrugation portions of panels 104B to the underlying structurals, another row of end overlapped panels 106B can be positioned adjacent to the panels 104B and form another standing seam 102. Once this has been achieved, the seam stabilizers 100A-C can be removed and repositioned over the newly formed standing seam 102 in the manner indicated in FIG. 9.

Figure 9:
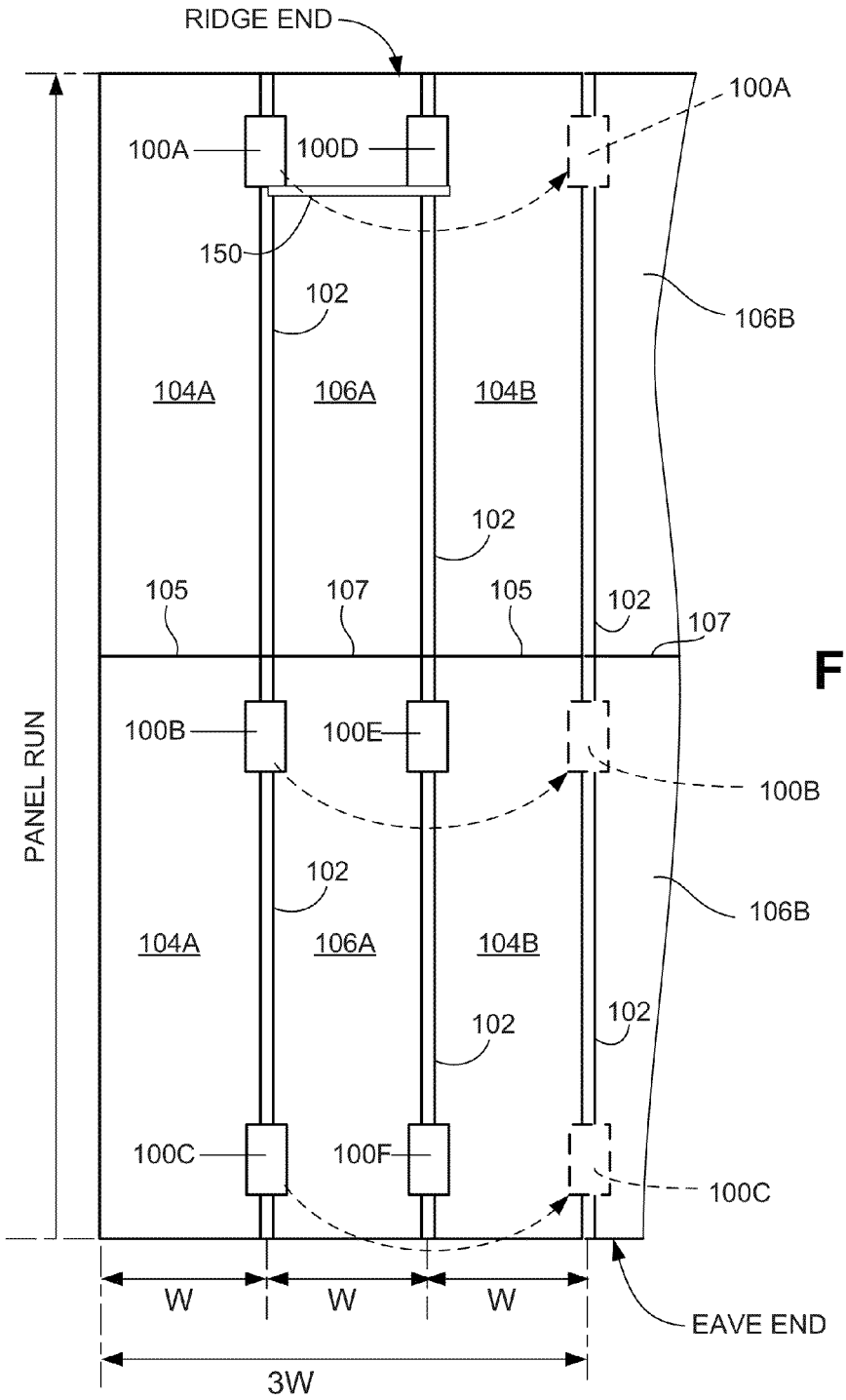
FIG. 9 is a diagrammatical representation of several roof panels illustrating the manner in which the seam stabilizer of FIG. 1 is employed in installation of the roof panels to form a standing seam roof with the roof panels being on module.

The number of seam stabilizers 100 to be used in practice will vary with the needs of a particular roof installation; for the purpose of the example depicted with reference to FIG. 9, three seam stabilizers are positioned along each of the standing seams, but this can be varied as necessary and the present invention is not limited to the number of seam stabilizers employed.

Figure 10:
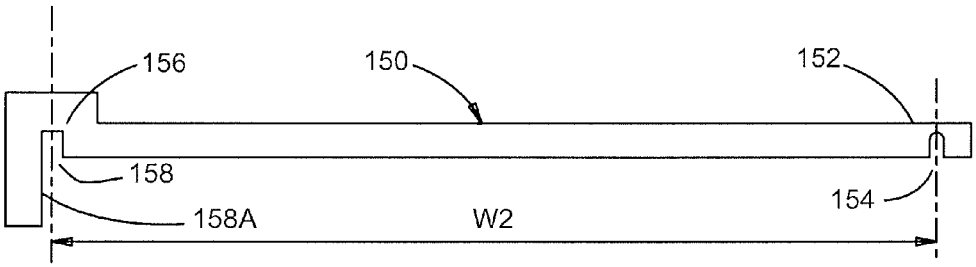
FIG. 10 is an elevational view of a module set gauge constructed in accordance with embodiments of the present invention.

As the panels 104 and 106 are positioned in the manner described to form the standing seam roof, the module integrity is greatly improved by the use of the seam stabilizer 100, the module integrity of a standing seam roof is further improved by another member of the seam stabilizer assembly, namely a module set gauge 150 as shown in FIG. 10. The module set gauge provides a means for maintaining a predetermined module distance between standing seams of adjacent roof panels during installation of the panels while also providing vertical alignment to the clips 132 as such 132 are attached via screw fasteners to the underlying support members 134.

The module set gauge 150 is an elongated body member having a first end 152 with a connecting groove 154, and a hook shaped second end 156 having a seam receiving groove 158, the centers of the grooves 154 and 158 being separated by the distance W2; the dimension W2 of FIG. 10 is determined to establish and maintain the module dimension W of FIG. 3. The size of the seam receiving groove 158 is determined so that this groove will fit over the male edge corrugation and the clip 132 attached to the male edge corrugation; one side 158A of the groove 158 is a substantially straight surface having a length that will extend vertically substantially along the upstanding length of the clip 132, and placed over the clip, serves to hold the clip vertically as it is attached to the support members 134.

The groove 158 is sized to fit over the edge male corrugation portion of the adjacent upstanding edge (the opposing edge of the panel forming the male corrugation that normally will be half of the next formed standing seam) at a position at which a clip 132 is to be attached (preferably the clip closest to the ridge, panel end overlap or eave) so that the opposing upstanding edge and clip are received in the seam receiving groove 158. An index pin 160 extends from the seam stabilizer 100 from the pivoting member 110 as shown in FIGS. 1 and 2, and the diameter of the index pin 160 is selected to be received in the groove 154. When the module set gauge 150 is connected to the index pin 160 via the connecting groove 154, the module set gauge 150 can extend across the panel being installed so that the seam receiving groove can be placed over the opposing upstanding edge and clip 132 to thereby secure the opposing upstanding edge at the modular distance W from the standing seam 102 formed by the overlapping edge corrugations of panels 104, 106 while the seam stabilizer 100 is positioned thereon. The location of the index pin 160 can be selected as desired, but it will be recognized that, if the index pin 160 is centered on the seam stabilizer 100, the dimension W2 will be determined to equal the module dimension W.

Referring once again to FIG. 9, as the roof panel installation proceeds, the module set gauge 150 can be used to set and maintain the module distance between panel runs. The module set gauge 150 extends between and engages the index pin 160 of clamped on seam stabilizers 100A and 100D, for example, as FIG. 9 depicts the use of a single module set gauge 150, but as will be further described, multiple set gauges can be employed.

Figure 9A:
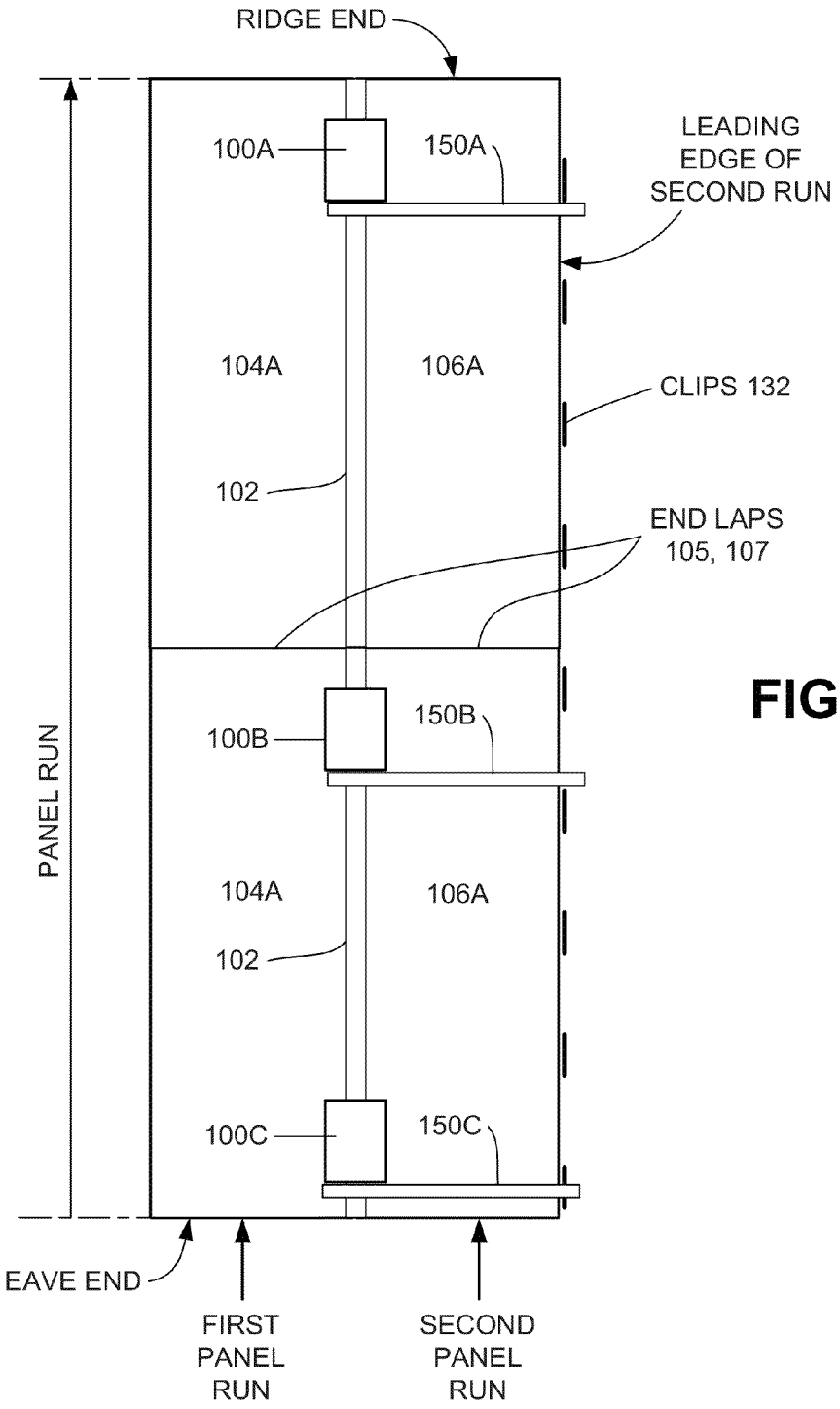

Turning to FIG. 9A, the sequencing of roof panel installation will be described in further detail. The roof panels are installed from the roof eave to the roof ridge. If panel run lengths are longer than that for which panels can be shipped, panel end laps are used to accommodate longer panel runs. The panel module can be effectively controlled by securing the panel seams to the panel module at panel ends only at the cave, ridge and end laps. If panel runs are of such length requiring only a single length panel, the panel module can be controlled by the use of seam stabilizers at the eave and at the ridge.

Shown in FIG. 9A is a typical roof installation panel placement of a roof having a panel run of a length of two panels in each panel run. For panel runs with two or more panels, quality module control requires the use of seam stabilizers 100 along with the use of the module set gauge 150 at the clip location nearest the endlap of the panels. The sequence of placement of panels can be understood by referring to that depicted by FIGS. 9A through 9C along with the following description.

In FIG. 9A, the panels of the first panel run (panels 104A) are positioned on the underlying support members, and clips are located and installed along the leading edge of the panels 104A. The panels of the second panel run (panels 106A) are placed into position, forming an overlapping standing seam 102 running along the edges and extending the length of the panels 104A and 106A; this standing seam is secured by the placement of seam stabilizers 100A, 100B and 100C that, once in place, lock the corrugation seam in proper shape and dimension. The module set gauges 150A, 150B and 150C are hooked to the seam stabilizer 100 by means of engaging the grooves 154 over the index pins 160, and hooking the grooves 158 over the opposing edge male corrugations at the leading edges of the second panel run (panels 106A) at a clip location (as noted above, preferably the clip closest to the ridge, panel endlap or cave). With the module set gauges in position, the leading edges (the edge male corrugations) are secured to the underlying support members 134 by attaching the clips 132 via appropriate fasteners; as observed above, the module set gauges 150 assure the vertical alignment of the clips as such are fastened to the support members 134, and once attached, the module set gauges 150 can be removed.

Figure 9B:
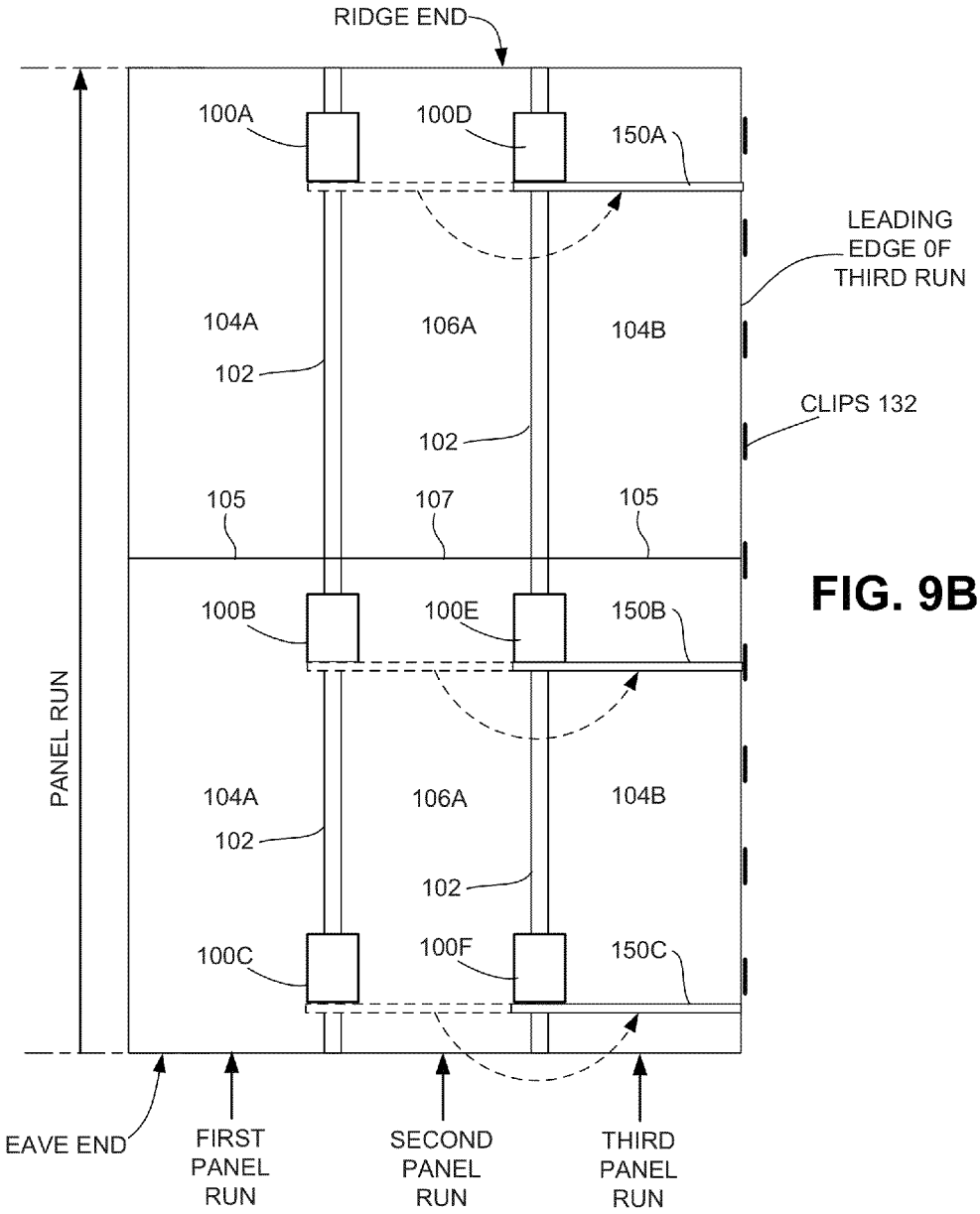

In FIG. 9B, the panels of the third panel run (panels 104B) are installed, engaging the seam portions of the panels 106A with the seam portions of panels 104B to form another standing seam 102. Seam stabilizers 100D, 100E and 100F are placed over this standing seam to lock the seam components in place to establish and secure the proper dimensions of the seams and corrugations forming same. Module set gages 150A, 150B and 150C previously removed from the second panel run can be connected to seam stabilizers 100D, 100E and 100F, and clips 132 installed along the leading edge of the third panel run to secure this edge to the underlying support members.

Figure 9C:
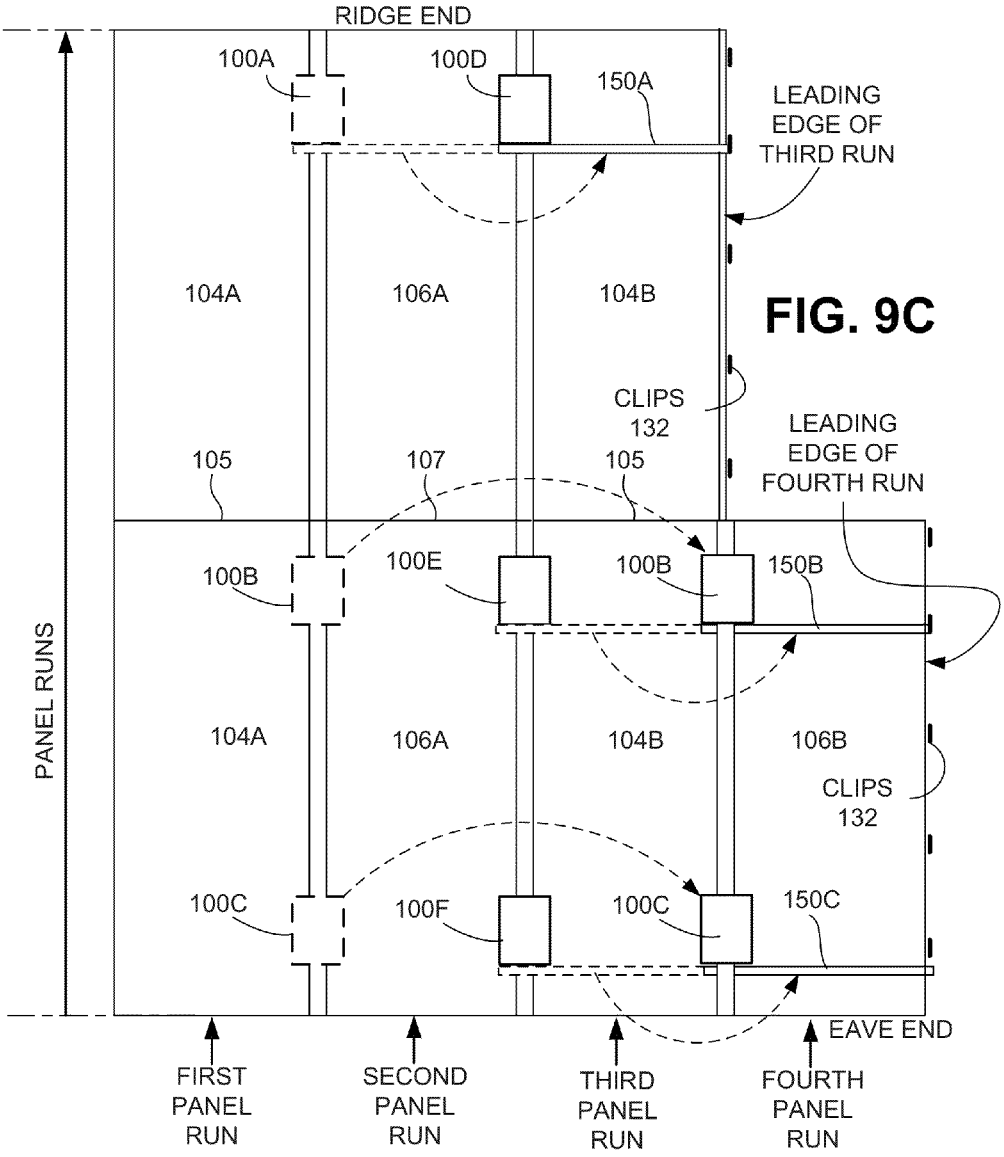

In FIG. 9C, the first panel of the fourth panel run (panels 106B) is installed by placing the panel 106B to form a corrugation and seam between the previously installed panel 104B and panel 106B. Seam stabilizers 100B and 100C are removed from the seam between the second and third panel runs and used on the corrugation and seam formed by the third and fourth panel runs (panels 104B and 106B). The module set gauges 150B and 150C removed from the third panel run can be connected to seam stabilizers 100B and 100C and the leading edge of panel 106B of the fourth panel run. This sequence is continued as other panel runs are placed, thus holding the panels in strict module.

Thus, the present invention provides an improved method of installing standing seam panels while stabilizing the horizontal and vertical profiles of the interconnected edge corrugations. As illustrated by the drawings, the inventive method comprises the steps of securing a first panel 104 to the underlying support members 134; positioning a second panel 106 adjacent to the first panel 104 and interconnecting the upstanding edge corrugations thereof to form a standing seam 102 along the length of the panels; stabilizing the horizontal and vertical profile of the interconnected edge corrugations and standing seam by pressing the profile members 116, 122 of the seam stabilizer 100 there against; securing the opposing upstanding leading edge of the second panel 106 by attaching same to the support members 134 by clips 132; removing (opening) the profile members 116, 122; and repeating these steps to install a third and subsequent panels.

Additional improvement in assuring on module installation of standing seam panels is achieved by, after stabilizing the profile of the interconnected edge corrugations and the standing seam by the profile members, connecting one end of the module set gauge 150 to one of the profile members by means of the connecting groove 154; and connecting the other end of the module set gauge 150 to the opposing upstanding edge of the second panel 106 at a clip location so that the opposing upstanding edge is set on module and the clip is held vertical as the clip is secured to the underlying support members. Once the clips are attached, the module set gauge 150 can be removed.

Normally the standing seams 102 will be seamed or crimped once the panels have been secured in place. The present invention provides profile stabilized seams that are on module, leading to better results with the seamer or crimper, meaning that tighter and more wear resistant standing seams can be achieved. Also, straighter standing seams result from the present invention, providing a more aesthetically pleasing roof. The superior seams made available by the apparatuses and methods taught herein lead to the consideration of a yet further use of the present invention in the art of remedial seaming or crimping of roof panels that have been installed and conventional seaming/crimping has failed to provide acceptable panel seams, that is, the seams may have splayed, leaving noticeable openings and possible crooked seams.

Remedial seaming or crimping of the seams can be achieved by positioning seam stabilizers 100 along the splayed seams to align the panel edge corrugations; the number of seam stabilizers needed will depend greatly on the severity of the seam disparities. Once the seams are closed by the seam stabilizers 100, the standing seam can be re-seamed (or re-crimped) by conventional means, removing the seam stabilizers 100 just in front of the seamer, thus closing the splayed seams for a more perfect seal and more aesthetically pleasing appearance.

Various other features and alternatives will readily occur to the skilled artisan in view of the foregoing discussion, as it is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. A seam stabilizer for maintaining the panels of a standing seam roof on module during installation of the standing seam roof, the panels having upstanding corrugations for the forming of standing seams interconnecting adjacent panels, the seam stabilizer comprising:

profile means responsive to a pressing force for maintaining the shape of the standing seam formed by interconnected upstanding corrugations of adjacent panels;

means for pressing the profile means to engage the standing seam to maintain a predetermined profile during installation of the panels; and a module set gauge comprising a body member having a connecting groove in a first end and having a seam receiving groove in a second end, the connecting groove and seam receiving groove being spatially separated by a distance substantially equaling a predetermined module distance of the panels and the seam receiving groove positional over a panel corrugation while holding a clip attached thereto vertically.

2. The seam stabilizer of claim 1 further comprising an index pin of a predetermined size and supported for being received in the connecting groove of the body member whereby the body member when extended across a panel can have the seam receiving groove placed over the opposing upstanding edge.

3. A method of installing standing seam roof panels while maintaining the panels on module, comprising the steps of:

a) securing a first panel, having a first upstanding angled surface to underlying support members;

b) positioning a second panel, having a second upstanding angled surface, adjacent to the first panel and interconnecting the panels to form a standing seam along the length of the panels, the first and second angled surfaces defining a substantially trapezoidal profile;

c) stabilizing the substantially trapezoidal profile by a seam stabilizer having a profile surface configured to simultaneously contact a proximal end and a distal end of one of the opposing angled surfaces;

d) securing the second upstanding angled surface of the second panel by attaching the second panel to the support members; and e) repeating steps b) though d) as subsequent panels are installed.

4. The method of claim 3, comprising, between steps c) and d), the steps of:

c2. connecting one end of a module set gauge to the seam stabilizer; and c3. connecting the other end of the module set gauge to the second upstanding angled surface of the second panel so that the substantially trapezoidal profile is set on module.

5. A seam stabilizer for maintaining the panels of a standing seam roof on module during interconnecting adjacent panels to form a standing seam, the operably interconnected panels having opposing angled surfaces substantially defining a trapezoidal upstanding profile, and the seam stabilizer comprising:

a profile surface configured to simultaneously contact a proximal end and a distal end of one of the opposing angled surfaces; and means for pressing the profile surface to maintain the substantially trapezoidal profile during the interconnecting of the panels; and means for maintaining a predetermined module distance between adjacent standing seams during the interconnecting of the panels wherein the means for maintaining a predetermined module distance is a module set gauge comprising:

a body member having a connecting groove in a first end and having a seam receiving groove in a second end, the connecting groove and seam receiving groove being spatially separated by a distance substantially equaling the predetermined module distance of the panels.

6. A seam stabilizer for maintaining the panels of a standing seam roof on module during interconnecting adjacent panels to form a standing seam, the operably interconnected panels having opposing angled surfaces when joined substantially define a trapezoidal upstanding profile, and the seam stabilizer comprising:

a first profile surface;

a second profile surface, the first and second profile surfaces configured to simultaneously contact a proximal end and a distal end of the opposing angled surfaces;

means for pressing the profile surfaces to maintain the substantially trapezoidal profile during the interconnecting of the panels, the means comprising:

a first handle connected to the first profile surface; and a second handle pivotally connected to the second profile surface so that the first and second profile surfaces are selectively pivotable by the first and second handles to an open mode and to a closed mode, the first and second profile surfaces in the closed mode are positioned to pressingly engage the opposing angled surfaces; and means for locking the first and second handles in the closed mode so that the opposing angled surfaces are gripped between the first and second profile surfaces.

* * * * *